United States Patent [19]

Hampel

[11] 4,069,935

[45] Jan. 24, 1978

[54] CHILD RESISTANT CLOSURE

[75] Inventor: Alfred H. Hampel, Woodside, N.Y.

[73] Assignee: Ferdinand Gutmann & Co., Brooklyn, N.Y.

[21] Appl. No.: 794,662

[22] Filed: May 6, 1977

[51] Int. Cl.[2] ..... B65D 55/02; B65D 85/56; A61J 1/00

[52] U.S. Cl. ..... 215/203; 215/220; 220/377

[58] Field of Search ..... 215/203, 219, 220; 220/377

[56] References Cited

U.S. PATENT DOCUMENTS

| | | | |
|---|---|---|---|
| 3,830,390 | 8/1974 | Gach | 215/220 |
| 3,853,236 | 12/1974 | Ostrowsky | 215/220 |

*Primary Examiner*—George T. Hall
*Attorney, Agent, or Firm*—Kirschstein, Kirschstein, Ottinger, Frank & Cobrin

[57] ABSTRACT

A screw-on child resistant double cap closure in which the inner screw cap has printing and coloration on the exterior surface of its crown and the cover is transparent. The cover and the screw cap include two halves of a selectively engagable, normally disengaged, torque coupling.

7 Claims, 7 Drawing Figures

CHILD RESISTANT CLOSURE

BACKGROUND OF THE INVENTION

1. Field of the Invention

A bottle with a screw-on child resistant double cap closure which only can be opened by the application to the cover of a supplemental force in addition to an unscrewing torque, making it virtually impossible for most children to remove the closure.

2. Description of the Prior Art

Poisonous and dangerous materials used in the home are kept in bottles having child resistant closures that can be removed with ease by an adult having average manual skill, strength and dexterity, but not by a child. Every year many children suffer from contacting, inhaling or swallowing materials that are harmful to them. Particularly prone are younger children who are inquisitive and interested in motion, assembly and disassembly and whose interest outweighs any knowledge or judgment they have acquired.

A popular child resistant closure is one having a double cap, a particular an inner screw cap and an outer cover that can be temporarily mechanically coupled to the cap by the application of a manual auxiliary force and of torque, enabling the closure to be removed. Closures of such type are exemplified by U.S. Pat. Nos. 2,061,214, 2,359,639, 2,710,701, 2,864,510, 2,881,934, 2,980,274 and 3,027,035.

A serious problem with such double caps is an inability to determine when the closure is firmly reclosed to be safe against opening by a child. Another problem is the need to apply printing or coloration to the cover in addition to the printing or coloration which already may have been applied to the inner screw cap. Still a further problem is the vulnerability to abrasion and wear of the printing of the overcap.

SUMMARY OF THE INVENTION

1. Purposes of the Invention

It is an object of this invention to provide an improved child resistant double cap screw closure that is not subject to the foregoing problems.

More particularly it is an object of this invention to provide a closure of the character described which furnishes to the user a visible indication of its secure reapplication to a bottle.

It is another object of this invention to provide a closure of the character described in which the printing or coloration that conventionally is applied to a simple screw cap serves to furnish the necessary information to a user without the need to reprint such information on the cover.

It is another object of this invention to provide a closure of the character described in which the printing conventionally furnished on a standard screw cap is protected against wear and abrasion by the cover.

It is another object of the invention to provide a closure of the character described which constitutes relatively few and simple parts and can be manufactured easily in mass production.

Other objects of the invention in part will be obvious and in part will be apparent from the following description.

2. Brief Description of the Invention

The screw-on child resistant double cap of the present invention is in many respects conventional. Thus it includes the customary inner screw cap which is made of sheet metal and which includes a crown, a skirt and, usually, a bead at the lower edge of the skirt. The skirt has a female thread that matches the male thread around the mouth of a bottle. The inner cap further includes one-half of a selectively engagable, normally disengaged, torque transmitting coupling which usually constitutes some form of irregularity on the crown, or the skirt, or the bead. The closure further includes a cover in which the inner cap is captive. The cover includes a crown, a skirt and an inwardly directed flange on the lower edge of the skirt. The cover has formed on its interior the other half of the selectively engagable, normally disengaged, torque transmitting coupling. The structures of the inner cap and of the cover are such that in their normal conditions the cover floats on the inner cap, that is to say, the two halves of the coupling are disengaged so that if the cover is twisted, the twisting motion is not transmitted to the inner cap, thus defeating the opening of the closure by a child.

Such an outer cover and an inner cap are well known, as is the use of a synthetic plastic for the material of the cover; however, heretofore the cover has been opaque and it has been necessary to print information on the cover and/or to color it in order to impart identification of product and/or manufacturer and/or instructions to the user concerning the contents of the bottle and the method of removal of the closure. In accordance with the present invention such printing no longer is necessary because the cover is transparent and the printing and/or coloration is applied to the inner cap and can be seen by the user through the cover. This arrangement has several advantages; for example, it protects the printing which heretofore was on the exposed cover. It enables the printing and/or coloration already to the inner cap to be used and therefore avoids the reprinting of the information and/or coloration on the cover. Most importantly, a consumer can see that the printing on the inner cap comes to a standstill when the closure is being tightened and starts to move when the user loosens it. The user instinctively becomes aware of the manner in which the closure operates and does not have to rely on instructions. He knows without having to rely upon tactile sensation when the closure is firmly tightened on the bottle and hence when the closure will impair a child's ability to remove it.

The invention accordingly consists in the features of construction, combinations of elements, and arrangements of parts which will be exemplified in the closure hereinafter described and of which the scope of application will be indicated in the appended claims.

BRIEF DESCRIPTION OF THE DRAWINGS

In the accompanying drawings in which is shown one of the various possible embodiments of the invention.

PREFERRED EMBODIMENT OF THE INVENTION

Figure 1:
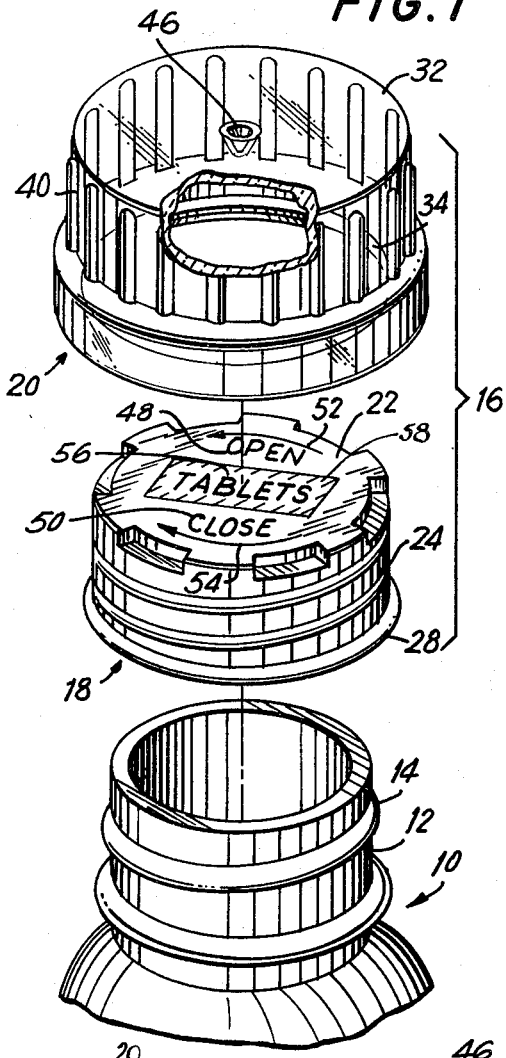
FIG. 1 is an exploded perspective view of a child resistant closure embodying the instant invention.

Referring now in detail to the drawings, the reference numeral 10 denotes a typical bottle adapted to contain material that is harmful or toxic to a child. The bottle can be made of any conventional substance and typically is fabricated from glass or plastic. The shape of the bottle has no bearing on the present invention; thus it may be cylindrical as indicated, or it may be rectangular or oval.

The bottle has a neck 12 which usually is of a smaller diameter than the major-sectional dimension of the body. The bottle is characterized by the presence of a male thread 14 on its neck.

To cap the bottle, a closure 16 is provided which is structured in accordance with the present invention. As previously mentioned, the closure is largely conventional and this conventional structure will be described first; the unique parts of the closure will be detailed subsequently.

The closure 16 includes two parts, namely, an inner screw cap 18 and an outer cover 20; hence the closure is a "double cap" type with the inner screw cap being captively held in the outer cover.

The inner cap 18 preferably is made from sheet metal that is strong enough to retain its shape when engaged with the screw thread 14 and is readily printable by inexpensive known printing techniques, e.g. lithographic. The cap 18 includes a crown 22, a skirt 24, and a female thread 26. Because the cap is made of sheet metal the outside of the skirt 24 is shaped as a replica of a female thread. The lower edge of the skirt 24 includes means to prevent a user from cutting himself, e.g. a rolled bead 28. A gasket 30, i.e. liner, is located against the undersurface of the crown 22, being held as by a ridge which constitutes the uppermost convolution of the female thread. The gasket may be resilient to aid in forming a liquid seal across the open mouth of the neck 12. The undersurface of the gasket may be water-impervious to assist in maintaining the integrity of the gasket. The upper surface of the gasket may be adhered to the crown.

The outer cover 20, like the inner screw cap, includes a crown 32 and a skirt 34. In addition, the cover has an inwardly directed flange 36 on the lower edge of the skirt 34.

Figure 3:
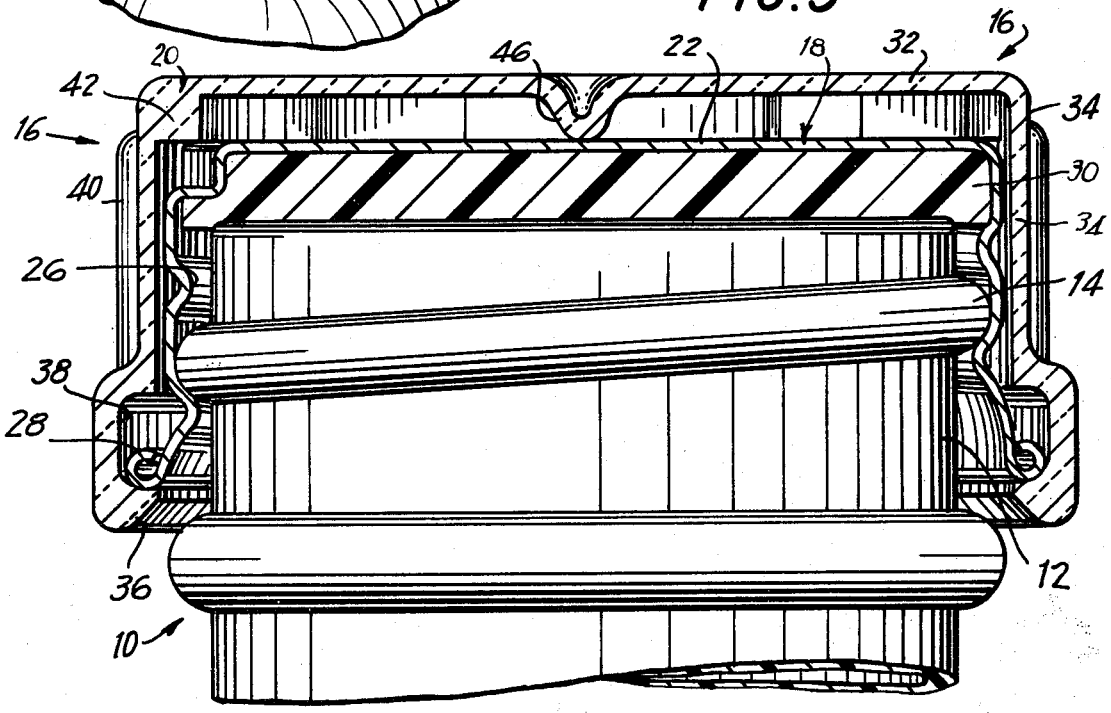
FIG. 3 is an enlarged sectional sectional view of the closure fast on the bottle top, the same being taken substantially along the line 3—3 of FIG. 2 and illustrating the torque transmitting means in uncoupled condition.
Figure 4:
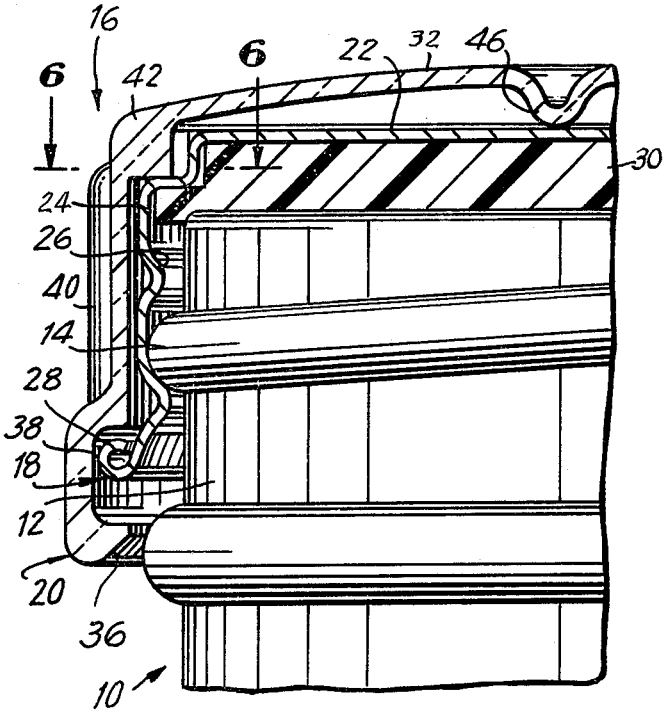
FIG. 4 is a view similar to FIG. 3, but showing the torque transmitting means in coupled condition.
Figure 5:
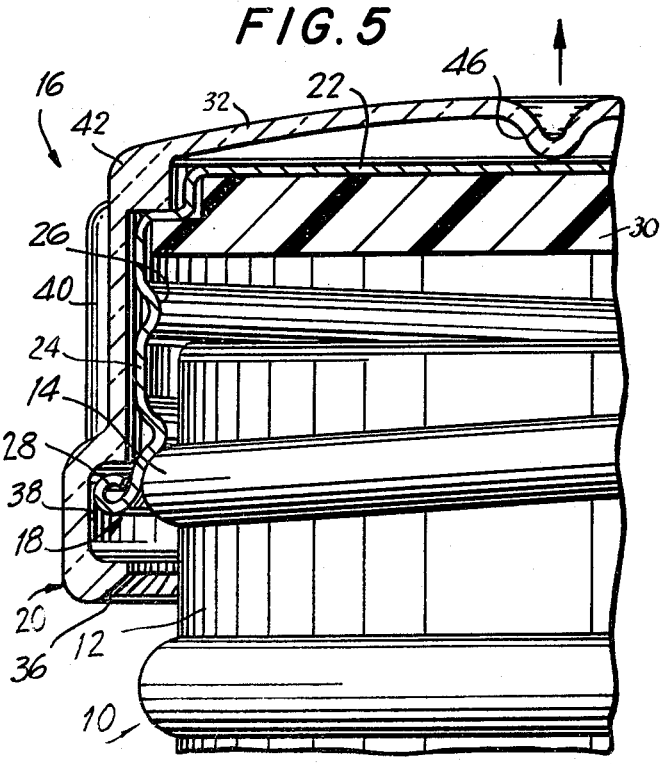
FIG. 5 is a view similar to FIG. 4, but showing the cap unscrewed from the bottle.

The outer cover ensheaths the screw cap which is captive therein; accordingly the interior diameter of the cover skirt 34 is slightly greater than the exterior diameter of the cap skirt 24. This permits the cap to rotate in the cover. The inner surface of the upper portion of the cover skirt 34 is smooth and cylindrical, that is to say it has no threads. The lower portion of the cover skirt is formed with an annular groove 38 the bottom of which constitutes a flange 36. This groove accommodates the bead 28. The groove is broader than the bead so that when the cap is within the cover they may be relatively moved in an axial direction from a position in which the bead butts against the lower wall of the groove 38 as illustrated in FIG. 3, to a position in which the bead butts against the upper wall of the groove as shown in FIGS. 4 and 5. The outer wall of the cover skirt 34 preferably includes means to facilitate gripping by a user's hand. As shown, said means constitutes a plurality of ribs 40 spaced equiangularly around the circumference of the skirt.

As thus far described, the cover and inner cap are conventional, and their structure is the same as that employed in prior art double cap child resistant closure.

Another feature of conventional double cap child resistant closures which is necessary for their operation and which is included in the closure of the present invention as a requisite torque transmitting coupling which, at the user's option, will transmit to the inner screw cap a twisting force applied to the outer cover. Said torque transmitting means consists of two halves, one half being part of the cover and the other half being part of the inner cap.

Any well-known type of torque transmitting means can be employed; a few will be mentioned by way of example. The torque transmitting means may include irregularities on the undersurface of the crown of the cover and matching irregularities on the outer surface of the crown of the inner cap. Alternately, the torque transmitting means may include an irregularity such as a series of driving lugs in the corner between the inner surface of the crown of the cover and the inner surface of the skirt of the cover which are adapted to cooperate with matching indentations in the corner between the outer surface of the crown of the inner cap and the outer surface of the skirt of the inner cap. Another useful torque transmitting means is a series of matching irregularities at the lower end of the outer cover and on the bead of the inner cap.

The matching irregularities on the inner surface of the cover and the outer surface of the inner cap normally are disengaged or, if engaged, are not operatively engaged and will ride out of engagement when torque is applied to the outer cover, such latter type of non-operative engagement being embraced by the term "normally disengaged." Normal disengagement is effected by any suitable mutual structuring of the cover and cap as, for example, by forming the cover with a central downward protuberance on the inner surface of its crown which engages the crown of the cap to keep the cover elevated but which will, due to the resilience of the cover, permit the cover to be forced down to cause the two halves of the torque transmitting means to be operatively engaged.

Another arrangement for maintaining the two halves of the torque transmitting means normally disengaged is to provide matching irregularities on the inner surface of the skirt of the cover and the outer surface of the skirt of the inner cap, and to so proportion the cover, the cap and the irregularities that the cover is free to turn on the inner cap unless the cover is constricted as by squeezing its skirt; the cover is sufficiently flexible to enable the skirt to be deflected inwardly enough to create an engagement between the irregularities on the cover and on the cap, so that torque can be transmitted.

These different types of selectively engageable normally disengaged torque transmitting means have been mentioned to make it clear that such a means is an essential part of the invention, but that the particular configuration of such means in any given case is not a limitation of the instant invention.

The specific torque transmitting means employed in the closure 16 now being described is of the type in which irregularities such as driving lugs are formed in the corners between the skirt and crown of the cover and the skirt and crown of the inner cap. More specifically, referring to the drawings, the cover 32 includes an equiangularly spaced set of driving lugs 42 on the inner surface of the cap 20 at the annular corner between the crown 32 and skirt 34 of said cover. Said lugs constitute one half of the torque transmitting means — the half carried by the cover. The other half of the torque transmitting means constitutes an equiangularly spaced series of indentations 44 located on the outer surface of the cap at the annular corner between the crown 22 and skirt 24 of the cap. The lugs and the indentations are arcuate, the lugs having a shorter circumferential angular span than the indentations. The angular center-to-center spacings of the lugs and of the indentations are the same. When a lug is received in an indentation, it does not fully fill the indentation lengthwise, so that there is lengthwise play between any given lug and the indentation with which it is at any given time associated. This permits relative angular movement between the lugs and the indentations. Such feature is not of critical importance. It is employed to enable the lugs to be fitted more easily into the indentations.

It will be appreciated that when the lugs are in the indentations, a driving torque connection is effected between the cover and the cap. However, normally the lugs are at a level such that they are above the crown 22 of the cap. This conveniently is achieved by providing a downwardly extending nub 46 centrally disposed on the undersurface of the crown 32. When the tip of the nub rides on the center of the exterior surface of the crown of the inner cap, the lower surfaces of the lugs 42 are at substantially the level of the upper surface of the crown of said inner cap so that the lugs are not in driving engagement with the indentations. If desired, the lugs may be at a slightly lower level which is such as to enable them to extend slightly into the indentations and, in this event, the ends of the lugs or the ends of the indentations are filleted to permit the lugs to ride over the indentations, albeit in a bumpy fashion, when the cover is twisted with respect to the cap but is not pressed down to ensure a firm driving connection between the lugs and the indentations.

The normally disengaged relationship between the cover and the inner cap is illustrated in FIG. 3.

When it is desired to turn the inner cap, and therefore the closure, with respect to the bottle so as to screw or unscrew the closure on the bottle threads 14, the cover is manipulated to apply two forces to it. One force is a twisting torque. The other force is an auxiliary force which is such as to cause the two halves of the torque transmitting means to become operatively engaged. In the closure here being described, the auxiliary force is a downwardly directed force on the cover to cause it to shift downwardly in relationship to the inner cap. This auxiliary force will displace the perimeter of the cover downwardly as shown, for example, in FIGS. 4 and 5. Such downward movement of the cover in conjunction with the twisting motion of the cover will first cause the lugs to turn with respect to the cover an amount enough to align the lugs with the indentations. Thereafter, the downwardly applied auxiliary force will cause the lugs to be seated in the indentations. At this time, the two halves of the torque transmitting means are operatively engaged and will transmit from the cover to the cap a twisting torque for either screwing or unscrewing the closure on or from the bottle.

Figure 6:
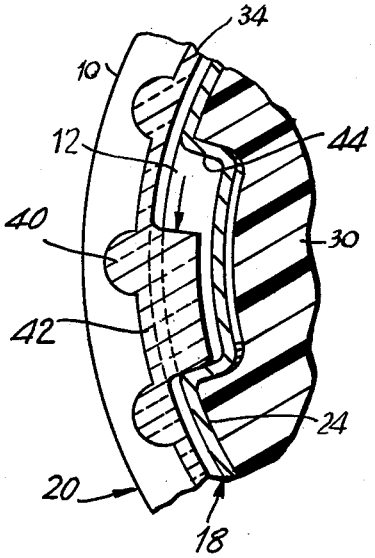
FIG. 6 is an enlarged fragmentary sectional view taken substantially along the line 6—6 of FIG. 4 and showing the engagement between the halves of the torque transmitting means as the closure is being unscrewed from a bottle.
Figure 7:
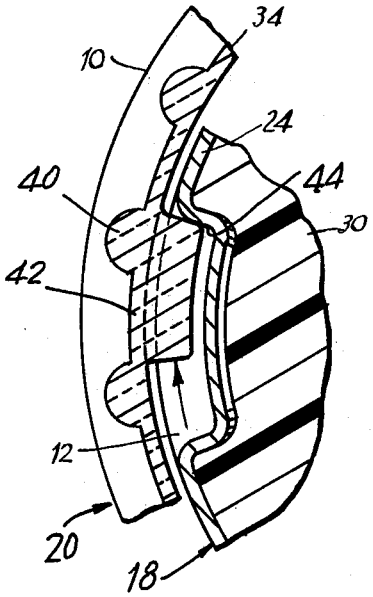
FIG. 7 is a view similar to FIG. 6 but showing the closure as it is being screwed on a bottle.

In FIG. 6 there is shown engagement of the driving lugs with the indentations while the cover is being turned in a counter-clockwise direction, which is the direction conventional for unscrewing the cover from the bottle. FIG. 7 shows the condition prevailing when the direction of rotation of the cover is reversed, i.e. when the cover is being turned to tighten an inner cap on a bottle.

In FIG. 4 the closure is shown in its tightened condition and, in contrast, in FIG. 5 the cover is shown in its unscrewed position ready to be lifted off the bottle.

Up to this point, the description of the closure 16 has been of a conventional closure of the double-cover child-resistant type. The closure of the present invention is distinguished from a conventional closure in that the outer surface of the crown 22 of the inner cap is visible through the cover to anyone handling the bottle. This visibility is the result of forming the cover 20 from a transparent plastic material, e.g. a synthetic resin, the transparency preferably being such that the cover is crystal clear at least at its crown 32. Preferably, the crown 32 is water white and desirably is free from any irregularities which would cause an optical distortion of the exterior surface of the crown 22 of the cover that is visible through it. An excellent material for the cover is an acrylic resin such as Lucite. Other suitable materials are polycarbonate, cellulose acetate, cellulose acetate butyrate, polyvinyl chloride, polypropylene, a copolymer of ethylene and propylene, and acrylonitrile-butadiene-styrene. It is within the ambit of the invention, although not preferred, to impart a light coloring to the crown of the cover which coloring is not sufficiently dark to noticeably affect visibility of the crown of the inner cover therethrough.

Figure 2:
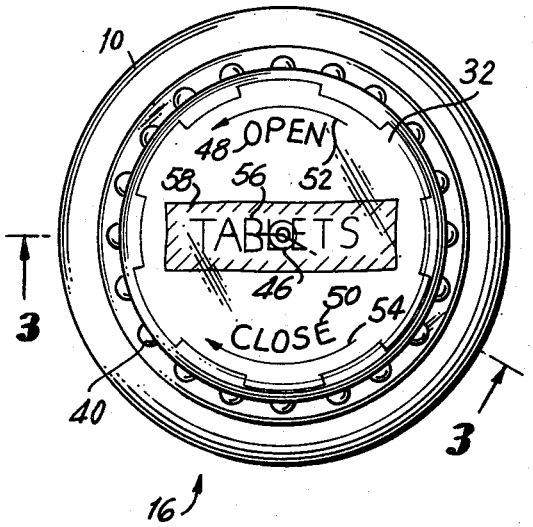
FIG. 2 is a top plan view of the closure.

Furthermore, pursuant to the present invention and as a requisit feature thereof to be employed in association and in combination with the transparent crown of the cover, printing is provided on the exterior surface of the crown 22 of the cap. This printing can be of various types. For example, as seen in FIGS. 1 and 2, the printing can include instructions as to the method of manipulation of the closure in order to apply the same to and disengage if from a bottle. The instructions can take the form of legends 48, 50, the legend 48 being associated with an arrow 52 showing a counter-clockwise direction of rotation, and the legend 50 being associated with an arrow 54 denoting a clockwise direction of rotation. The legend 48 reads "OPEN," meaning that if the double-cap closure is turned in the direction of the associated arrow 52, it will be unscrewed from the bottle; the legend 50 read "CLOSE," meaning that if the double-cap closure is turned in the direction of the associated arrow 54, said closure will be screwed onto the bottle.

Furthermore, the exterior surface of the crown of the cap includes identification printing 56 which will advise the user of the contents of the bottle, or may advise the user of the manufacturer of the contents of the bottle, or may advise the user of the name or brand of the contents of the bottle. Additional information may be included on the upper surface of the crown of the inner cap such, for instance, as a diametral coloration 58 which may extend over the entire surface of the crown or may be in a pattern such as the rectangle indicated in the drawings. The coloration may be one associated with a specific manufacturer, and the configuration of the coloration also may be associated with a specific manufacturer so that a user, when viewing the bottle which is capped by the closure, will associate it with the manufacturer and/or with a particular type of product or medication, this being by virtue of a secondary meaning that the coloration may have acquired.

The use of a transparent overcap together with a printing inner cap creates several decided advantages. For example, the instructions for opening or closing the cap are made readable. Furthermore, the person manipulating the closure instinctively will become aware of the manner in which this closure operates because he can tactilely sense the direction of the twisting torque applied and he can tactilely sense the direction in which he applies the auxiliary force to the cap while at the same time being visually aware of whether or not the inner cap moves with the cover or remains stationary while the cover is turned. He quickly will associate in his mind the necessity for applying the downwardly oriented (in this particular case) force concurrent with the twisting motion for closing or opening, and thus, without reading any instructions, quickly will be educated as to proper manipulation of the closure for capping or uncapping the container. It is his ability to see through the crown of the cover and visually ascertain the motion or non-motion of the printed material on the cap that imparts this instinctive instruction to the user. A diametrally oriented coloration heightens the visual acuity of the user.

Desirably, the printing on the inner cap is such that movement or non-movement thereof will become immediately apparent to someone manipulating the cover. Hence, such printing should include at least a portion which is non-uniform or which is nonconcentric. For example, if the entire crown of the inner cap were all of one color with no interruptions of any type, e.g. an all-yellow inner cap, the present invention would not be effected; or, if the printing were all in the form of continuous circles concentrically disposed about the center of the inner cap, the present invention likewise would not be effected because, in both cases, the user would not be able to tell from looking at the cap through the cover whether the cap was being turned or remained stationary. However, by having printing provided on the exterior surface of the inner cap, which is in none of the aforesaid shapes but has its own discontinuous shapes, e.g. as of a diametral nature such as the coloration 58, or is of a non-fully-circular arcuate nature such as the legends 48, 50 or the arrows 52, 54, the user, without being consciously aware of it, will recognize rotation or non-rotation of the inner cap.

In addition, the printing on the inner cap is protected by the cover so that it is not scratched or worn off and the bottle thus retains its indentification indefinitely.

It thus will be seen that there is provided a device which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

Having thus described the invention there is claimed as new and desired to be secured by Letters Patent:

1. A screw-on, child-resistant, double-cap closure for a container having a neck with a male thread thereon, said closure comprising:

A. an inner screw cap having
  I. a crown,
  II. a skirt and
  III. a bead,
  IV. the inner surface of the skirt including a female thread that matches the male thread on the container, and B. a cover having
  I. a crown and
  II. a skirt,
  III. said cover including an annular groove adjacent the bottom of the skirt, C. said cap being disposed concentrically within said cover, with said bead within said groove so that said cap is captive within said cover, D. a selectively engageable normally disengaged torque transmitting coupling constituting two halves of which one half is a part of the cover and the other half is a part of the cap, said coupling being engageable upon the application of an auxiliary force to the cover whereby to render the coupling drivingly engageable to transmit to the cap torque imparted to the cover, said closure including an improvement comprising:

E. the transparency of at least the crown of the cover so that the exterior surface of at least the crown of the cap is visible therethrough, and F. non-uniform, non-concentric printing on the exterior surface of the crown of the cap, which printing is viewable through the crown of the cover, whereby the user instinctively, by viewing the printing on the cap as he manipulates the cover, becomes aware of the proper manner of applying forces including a twisting force and an auxiliary force to the cover in order to screw the closure on or unscrew the closure from the container.

2. A closure as set forth in claim 1, wherein the cover is made from a synthetic resin selected from the group consisting of acrylics, polycarbonates, cellulose acetate, cellulose acetate butyrate, polyvinyl chloride, a copolymer of ethylene and propylene, polypropylene and acrilonitrile-butadiene-styrene.

3. A closure as set forth in claim 1, wherein the crown of the cover is optically clear.

4. A closure as set forth in claim 1 wherein the crown of the cover is flat.

5. A closure as set forth in claim 1 wherein the printing on the cap includes letters.

6. A closure as set forth in claim 1 wherein the printing on the cap includes symbols.

7. A closure as set forth in claim 1 wherein the printing includes a diametrally oriented area.

* * * * *